US007627910B2

(12) United States Patent
Davis

(10) Patent No.: US 7,627,910 B2
(45) Date of Patent: Dec. 8, 2009

(54) PARTIALLY DEFLATABLE TRANSFER MATTRESS AND METHOD FOR TRANSPORTING A PATIENT IN COMFORT

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 365 days.

(21) Appl. No.: 11/751,864

(22) Filed: May 22, 2007

(65) Prior Publication Data

US 2008/0289102 A1 Nov. 27, 2008

(51) Int. Cl.
*A61G 7/14* (2006.01)
*A47C 27/10* (2006.01)

(52) U.S. Cl. ..... 5/81.1 R; 5/81.1 HS; 5/710; 5/711; 5/713

(58) Field of Classification Search ..... 5/81.1 R, 5/81.1 HS, 706, 710–715, 644, 654, 655.3, 5/932

See application file for complete search history.

(56) References Cited

U.S. PATENT DOCUMENTS

| | | | | | |
|---|---|---|---|---|---|
| 1,235,669 | A | * | 8/1917 | Eggers | 604/357 |
| 2,542,781 | A | | 2/1951 | Sawyer | 5/348 |
| 4,225,989 | A | | 10/1980 | Corbett et al. | 5/453 |
| 4,279,044 | A | | 7/1981 | Douglas | |
| 4,517,690 | A | | 5/1985 | Wegener | 5/81 R |
| 4,528,704 | A | | 7/1985 | Wegener et al. | 5/81 R |
| 4,541,135 | A | * | 9/1985 | Karpov | 5/710 |
| 4,686,719 | A | | 8/1987 | Johnson et al. | 5/81 R |
| 4,744,112 | A | * | 5/1988 | Keesling, Jr. | 5/710 |
| 4,964,183 | A | * | 10/1990 | LaForce, Jr. | 4/585 |
| 5,067,189 | A | | 11/1991 | Weedling et al. | 5/81 R |
| 5,423,094 | A | | 6/1995 | Arsenault et al. | 5/455 |
| 5,425,147 | A | * | 6/1995 | Supplee et al. | 5/713 |
| 5,483,709 | A | | 1/1996 | Foster et al. | 5/81.1 |
| RE35,299 | E | * | 7/1996 | Weedling et al. | 5/81.1 T |
| 5,535,463 | A | | 7/1996 | Chiu | 5/452 |
| 5,561,873 | A | | 10/1996 | Weedling | 5/711 |
| 5,598,593 | A | | 2/1997 | Wolfe | 5/710 |
| 5,860,174 | A | | 1/1999 | Failor | 5/81.1 HS |
| 6,073,291 | A | | 6/2000 | Davis | 5/711 |

(Continued)

OTHER PUBLICATIONS

PCT/US2008/064201 International Search Report.

(Continued)

*Primary Examiner*—Robert G Santos
(74) *Attorney, Agent, or Firm*—Duane Morris LLP

(57) ABSTRACT

A transfer mattress includes an upper mattress having three longitudinally oriented plenums and three separate inlet/outlet valves that are each arranged in airflow communication with their respective plenum. First and second of the plenums are arranged in airflow communication with one another while a central plenum is arranged in airflow isolation from the first plenum and the second plenum so that the first and second plenums may be inflated and deflated independently of the central plenum. A lower inflatable mattress is separated by a common wall from the upper mattress. A lower inlet/outlet valve is arranged in airflow communication with a lower plenum defined by the lower inflatable mattress. A bottom wall defines a plurality of perforations so that when the lower plenum is charged with pressurized air, it escapes under pressure through the perforations to create an air bearing under the mattress. A method for transporting a patient in comfort is also provided by the invention.

6 Claims, 16 Drawing Sheets

U.S. PATENT DOCUMENTS

| | | | | |
|---|---|---|---|---|
| 6,463,610 | B1 * | 10/2002 | Shulte et al. | 5/712 |
| 6,467,106 | B1 | 10/2002 | Heimbrock | 5/81.1 C |
| 6,618,884 | B1 | 9/2003 | Wu | 5/706 |
| 6,671,910 | B2 | 1/2004 | Hsu et al. | 5/710 |
| 6,701,559 | B2 | 3/2004 | Boso et al. | 5/739 |
| 6,898,809 | B2 * | 5/2005 | Davis | 5/81.1 R |
| 6,996,867 | B2 | 2/2006 | Boso et al. | 5/739 |
| 7,107,641 | B2 | 9/2006 | Davis | 5/710 |
| 7,373,680 | B2 * | 5/2008 | Davis | 5/711 |
| 7,376,995 | B2 * | 5/2008 | Davis | 5/710 |
| 7,565,709 | B2 * | 7/2009 | Davis | 5/710 |
| 7,591,029 | B2 * | 9/2009 | Weedling et al. | 5/81.1 R |
| 2004/0226101 | A1 | 11/2004 | Lin et al. | 5/710 |
| 2005/0034242 | A1 * | 2/2005 | Davis | 5/711 |
| 2005/0091751 | A1 * | 5/2005 | Davis | 5/711 |
| 2005/0132490 | A1 * | 6/2005 | Davis | 5/81.1 R |
| 2006/0021133 | A1 * | 2/2006 | Davis | 5/81.1 R |
| 2006/0101581 | A1 | 5/2006 | Blanchard | |
| 2006/0162086 | A1 * | 7/2006 | Davis | 5/711 |
| 2007/0000048 | A1 | 1/2007 | Davis | |
| 2007/0006385 | A1 * | 1/2007 | Davis | 5/710 |
| 2008/0011989 | A1 * | 1/2008 | Davis | 254/93 HP |
| 2008/0104762 | A1 * | 5/2008 | Davis | 5/621 |
| 2008/0189866 | A1 * | 8/2008 | Davis | 5/711 |
| 2008/0289102 | A1 * | 11/2008 | Davis | 5/81.1 R |

OTHER PUBLICATIONS

PCT/US2008/064201 International Search Report, mailed Sep. 2, 2008.

* cited by examiner

PARTIALLY DEFLATABLE TRANSFER MATTRESS AND METHOD FOR TRANSPORTING A PATIENT IN COMFORT

FIELD OF THE INVENTION

The present invention generally relates to patient transfer devices and, more particularly to a patient transfer apparatus which employs an air bearing to facilitate the transfer.

BACKGROUND OF THE INVENTION

Patient handling mattresses are known in the art which include at least two flexible material sheets that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface such as a floor or table. When the mattress is charged with pressurized air the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

For example, in U.S. Pat. No. 4,517,690, issued to Wegener, an air pallet is disclosed that is formed from upper and lower thin flexible film sheets sealed at their edges to form a plenum chamber. Wegener's air pallet functions to move a load with minimal friction over an underlying generally planar fixed support surface. The bottom thin flexible material sheet is perforated by small diameter perforations such as pin holes at the load imprint area.

In U.S. Pat. No. 5,561,873, issued to Weedling, provides an inflatable flexible pallet within which an array of structurally interrelated inflatable chambers are formed to support a load when inflated. The flexible pallet is configured to resist lateral and longitudinal shrinkage of the load support surface, as well as ballooning and hot dogging. Rotational instability is also reduced by providing a greater load surface support area.

In U.S. Pat. No. 6,073,291, issued to Davis, an inflatable medical patient transfer apparatus is disclosed that has a combination of transverse partition members and a raised perimeter section to reduce deleterious ballooning and uneven inflation as well as quick emergency deflation. Additional differentially inflatable patient rolling chambers are disclosed on the top of the transfer apparatus to provide assistance to medical personnel in beginning to roll patients reclining or lying upon the transfer apparatus, particularly in a deflated condition on a hospital bed.

In U.S. Pat. No. 7,107,641, issued to Davis, a double chambered transfer mattress is provided capable of partial deflation that includes a top inflatable mattress and a bottom inflatable mattress that are separated by a common wall from one another. A selectable inlet/outlet valve is arranged for airflow communication between an interior chamber of the bottom inflatable mattress and a source of pressurized air. A one-way valve is positioned through the common wall so as to provide selective air flow communication between the top inflatable mattress and the bottom inflatable mattress so that when the inlet/outlet valve is opened, so as to deflate the bottom inflatable mattress, the one-way valve is actuated so as to prevent deflation of the top inflatable mattress.

All of the foregoing devices have suffered from an inability to be used on a patient transfer vehicle, e.g., a typical wheeled hospital bed or gurney, when fully or even partially inflated.

Such patient transfer vehicles often include a frame, a patient pallet supported by the frame, and a pair of side rails that are movably coupled to the frame for movement between a raised position and a lowered position relative to the patient pallet's surface. When an inflated prior art transfer mattress is placed upon the patient pallet's surface, and an attempt is made to lift the side rails into their raised position, they collide with the margins of the inflated transfer mattress. This has required the complete deflation of such transfer mattresses while resident upon a patient transfer vehicle, resulting in discomfort for the patient.

SUMMARY OF THE INVENTION

The present invention provides a mattress having three adjacent longitudinally oriented plenums at least two separate inlet/outlet valves, one of which is arranged in airflow communication with a respective two of the three adjacent plenums. In one embodiment, two of the plenums are spaced apart from one another but arranged in airflow communication with one another, while a third of the plenums is located between the spaced apart plenums. The third plenum is arranged in airflow isolation from the communicating plenums so that the communicating plenums may be inflatable or deflatable independently of the third plenum.

In an alternative embodiment, a transfer mattress is provided that includes an upper mattress that defines a first longitudinally oriented plenum having a first inlet/outlet valve arranged in airflow communication with the first plenum, a central longitudinally oriented plenum having a central inlet/outlet valve arranged in airflow communication with the central plenum, and a second longitudinally oriented plenum having a second, optional inlet/outlet valve arranged in airflow communication with the second plenum. The first and second plenums are arranged in airflow communication with one another while the central plenum is arranged in airflow isolation from the first plenum and the second plenum. In this way, the first and second plenums may be inflated and deflated independently of the central plenum so as to allow for the positioning of the mattress on support surfaces of varying width. A lower inflatable mattress is separated by a common wall from the upper mattress. A lower inlet/outlet valve is arranged in airflow communication with a lower plenum defined by the lower inflatable mattress. A bottom wall defines a plurality of perforations so that when the lower plenum is charged with pressurized air through the lower inlet/outlet valve, the escape of the air under pressure through the perforations creates an air bearing.

In a further embodiment, a transfer mattress is provided that includes an upper mattress that defines a first longitudinally oriented plenum having a first inlet/outlet valve arranged in airflow communication with the first plenum, a central longitudinally oriented plenum having a central inlet/outlet valve arranged in airflow communication with the central plenum, and a second longitudinally oriented plenum. The first and second plenums are arranged in airflow communication with one another while the central plenum is arranged in airflow isolation from the first plenum and the second plenum. In this way, the first and second plenums may be inflated and deflated independently of the central plenum so as to allow for the positioning of the mattress on support surfaces of varying width. A lower inflatable mattress is also provided that is separated by a common wall from the upper mattress. A lower inlet/outlet valve is arranged in airflow communication with a lower plenum defined by the lower inflatable mattress. A bottom wall of the lower mattress defines a plurality of perforations so that when the lower plenum is charged with pressurized air through the lower inlet/outlet valve, the escape of that air under pressure through the perforations creates an air bearing.

A method for transporting a patient in comfort is also provided wherein a patient is positioned upon a transfer mattress formed in accordance with anyone of the foregoing embodiments comprising three adjacent longitudinally oriented plenums wherein at least one of the plenums is pressurizable independently of the other two plenums. The transfer mattress is then moved from a first location to a mobile transport device, e.g., a patient gurney, of the type that often have adjustable side railings. Two out of the three plenums are then deflated so that the patient is supported only upon the at least one of the plenums that is independently pressurizable. The patient is then transported upon the mobile transport, often with the adjustable railing arranged in position on either side of the patient without interference or obstruction by the deflated portions of the transfer mattress.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
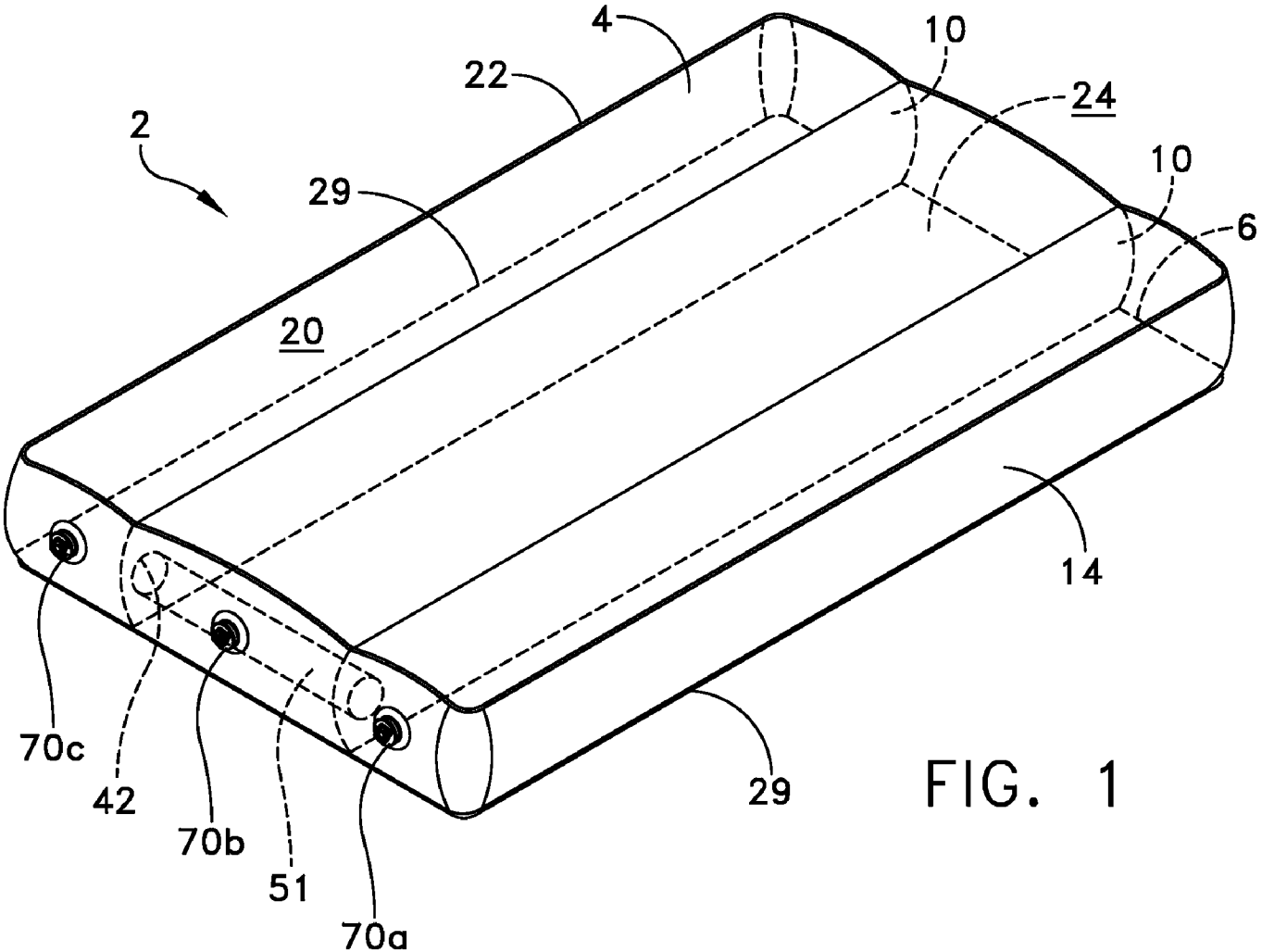
FIG. 1 is a perspective view of a multichambered mattress formed in accordance with the present invention.
Figure 1A:
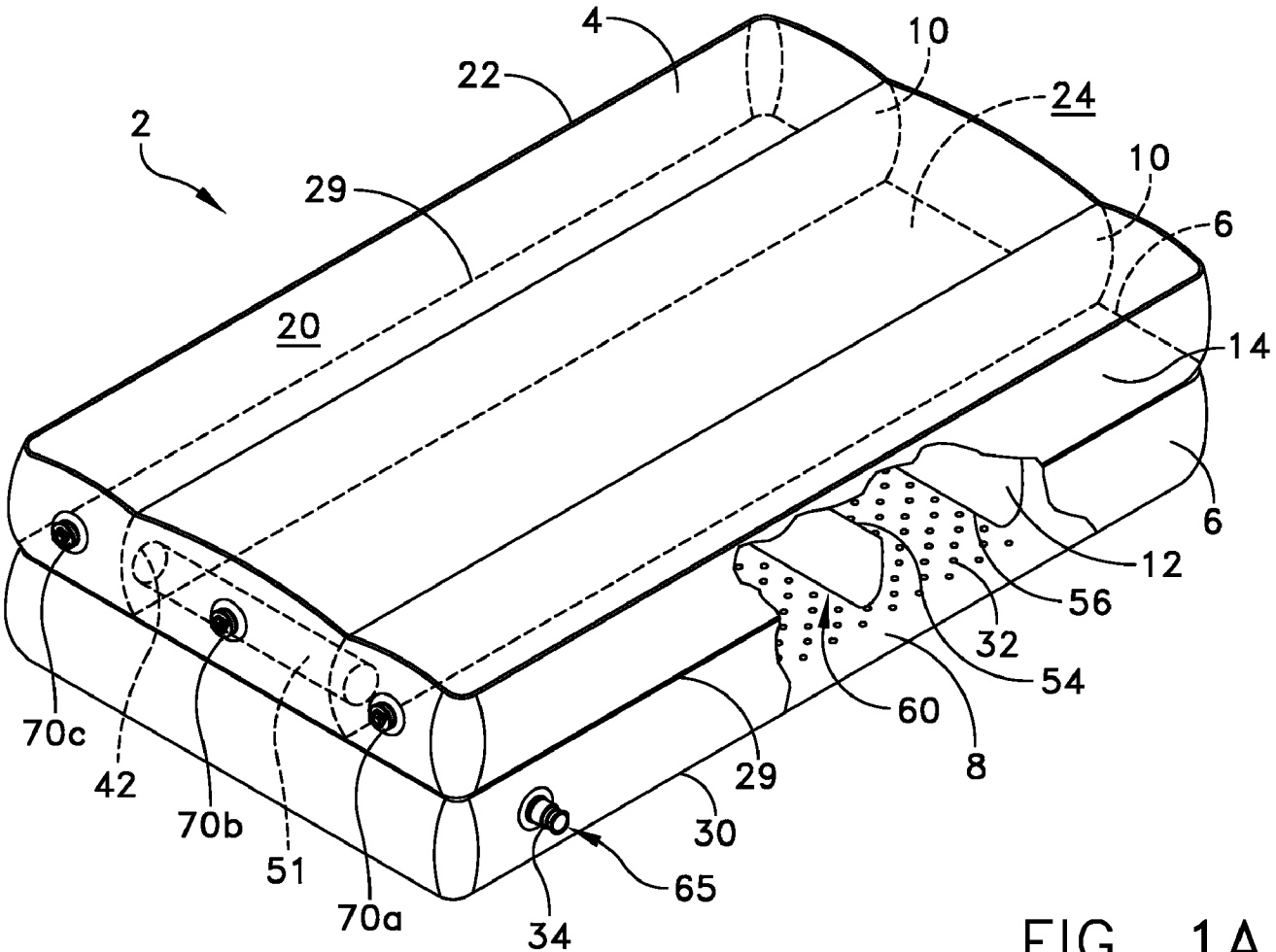
FIG. 1A is a perspective view, partially broken-away of a multichambered mattress formed in accordance with the present invention in combination with a transfer mattress formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Referring to FIGS. 1-4, a partially deflatable, multichambered transfer mattress 2 is provided that includes a top panel 4, a barrier panel 6, a bottom panel 8, at least two longitudinal baffle-panels 10, a plurality of transverse baffle-panels 12, a top perimeter band 14, and a bottom perimeter band 16. More particularly, top panel 4 has a top surface 20 and a peripheral edge 22, and often comprises a rectangular shape. Barrier panel 6 includes a top inner surface 24, a bottom inner surface 26, and a peripheral edge 29, and is substantially the same in length and width as top panel 4. Bottom panel 8 has a peripheral edge 30, and includes a plurality of perforations 32 that are defined through its thickness to allow air, that is supplied by a high-pressure air supply to partially deflatable multichambered transfer mattress 2 via an air supply hose 34, to escape in a controlled manner. A portion of the air supplied to partially deflatable, multichambered transfer mattress 2 escapes through plurality of perforations 32, providing a weight-bearing cushion of air that facilitates the sliding of partially deflatable, multichambered transfer mattress 2 along a surface, as well as, from one surface to another.

Figure 1B:
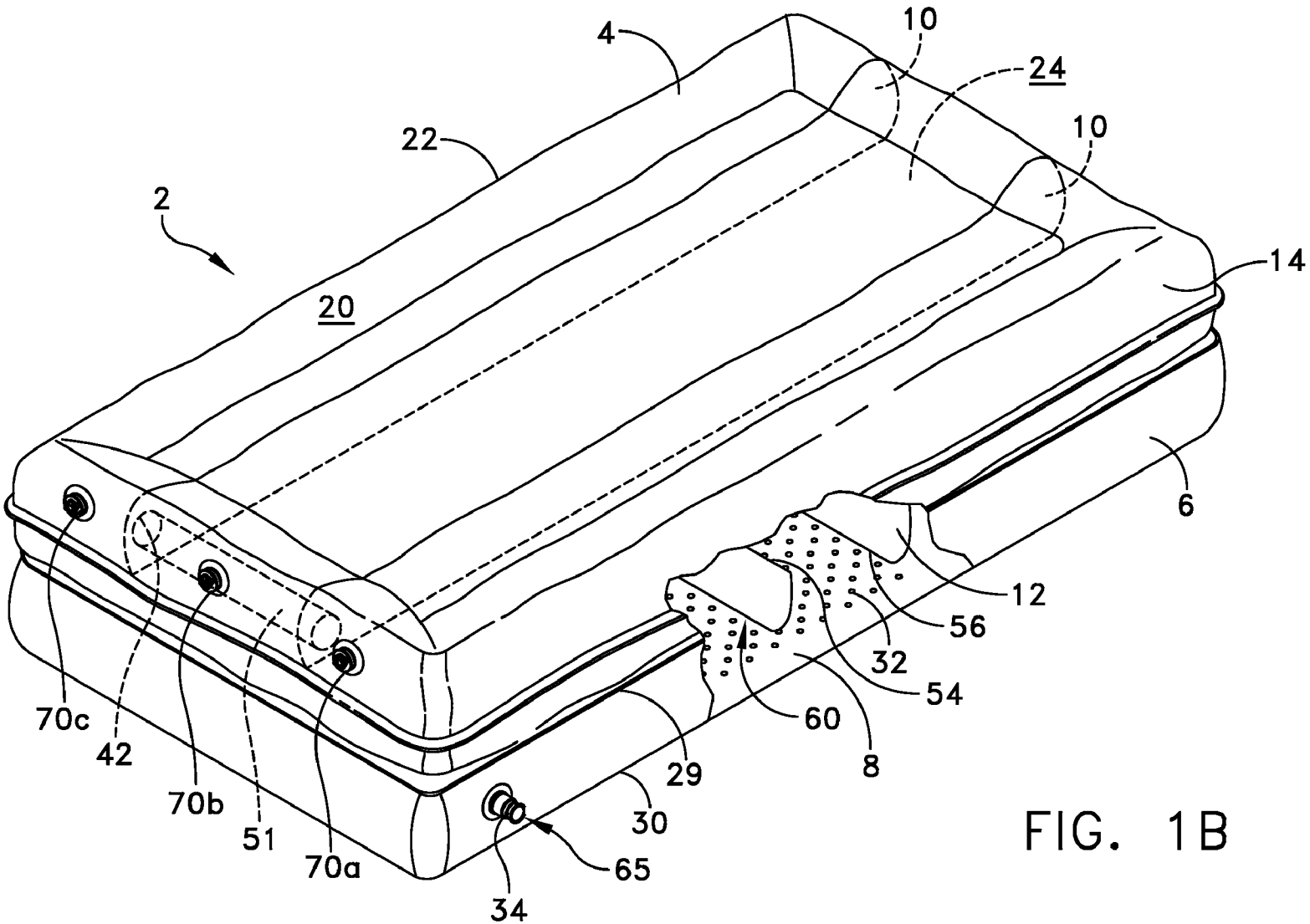
FIG. 1B is a perspective view, partially broken-away of a multichambered mattress, having a single perimeter seal formed in accordance with the present invention in combination with a transfer mattress formed in accordance with the present invention.
Figure 2:
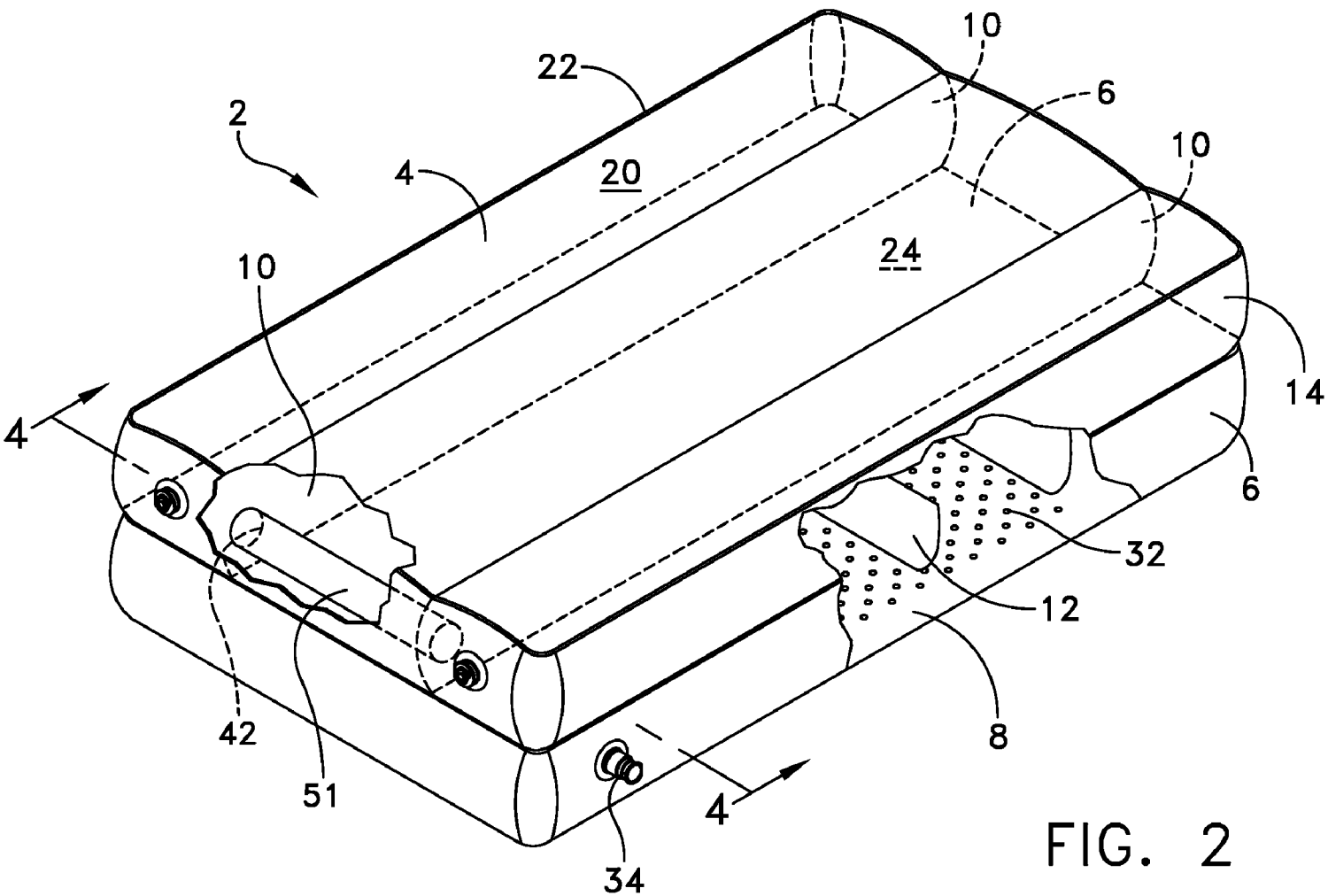
FIG. 2 is a further perspective view of the multichambered mattress formed in accordance with the present invention in combination with a transfer mattress formed in accordance with the present invention shown in FIG. 1A, with an end portion cutaway for clarity of illustration.
Figure 3:
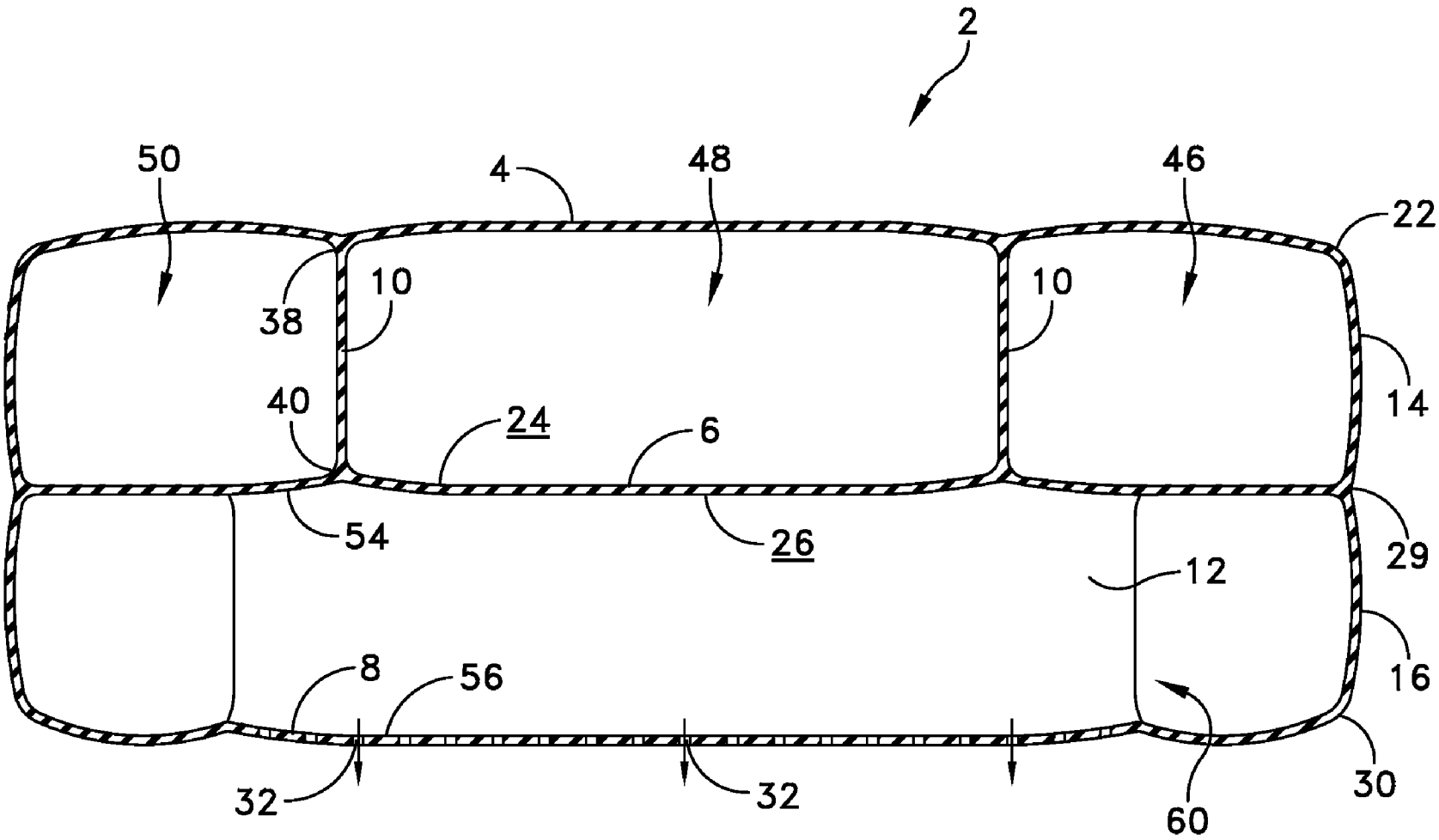
FIG. 3 is a cross-sectional view of the multichambered transfer mattress shown in FIG. 2.
Figure 4:
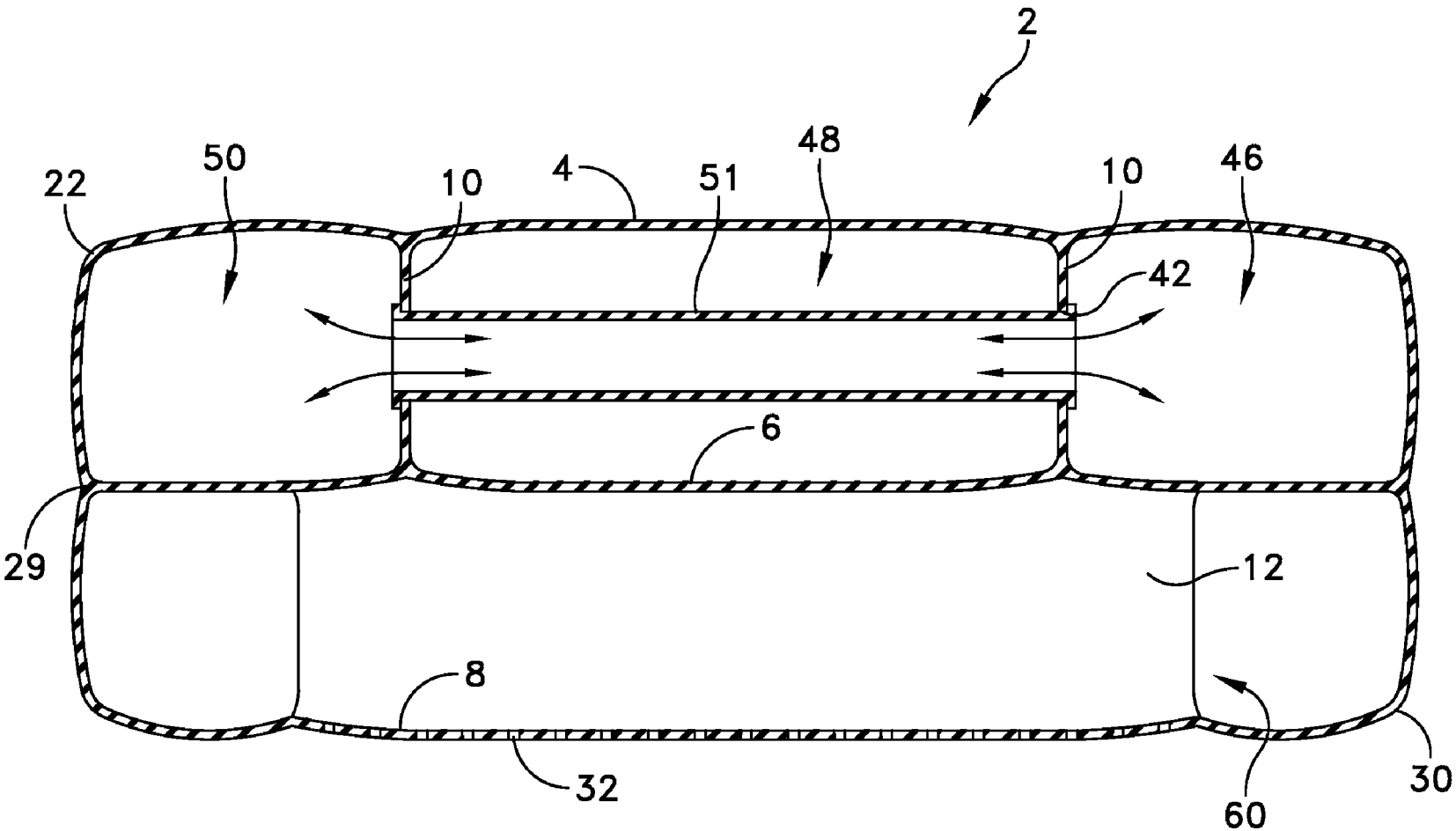
FIG. 4 is a cross-sectional view of the multichambered transfer mattress shown in FIG. 2, as taken along lines 4-4.

Longitudinal baffle-panels 10 each comprise substantially rectangular sheets, and include a top edge 38, a bottom edge 40, and in some embodiments a through-hole 42. Each Longitudinal baffle-panel 10 preferably has substantially the same length as top panel 4 and barrier panel 6 and, in embodiments that do not feature a single perimeter seal (FIG. 1B) substantially the same width as top perimeter band 14. Two longitudinal baffle panels 10 are installed within an upper portion of partially deflatable, multichambered transfer mattress 2, so as to form a first plenum 46, a central plenum 48, and a second plenum 50 that are peripherally enclosed by top perimeter band 14. A conduit 51 is arranged in flow communication with each of through-holes 42 so that first plenum 46 and second plenum 50 are in airflow communication with one another, and in airflow isolation from central plenum 50. Plurality of transverse baffle-panels 12 each often have a substantially rectangular shape, and include a top edge 54 and a bottom edge 56. Baffle-panels 12 may have differing widths, depending upon their position within a lower plenum 60 of partially deflatable, multichambered transfer mattress 2. Transverse baffle panels 12 are installed within lower plenum 60 of partially deflatable, multichambered transfer mattress 2, with each top edge 54 being fastened transversely to a portion of bottom inner surface 26 and bottom edge 56.

Top perimeter band 14 and a bottom perimeter band 16 often take the form of elongate, rectangular strips of material. Top perimeter band 14 is sealingly fastened between peripheral edge 22 of top panel 4 and peripheral edge 29 of barrier panel 6, e.g., by heat sealing, gluing or sewing, so as to complete the formation of first plenum 46, central plenum 48, and second plenum 50. Bottom perimeter band 16 is sealingly fastened between peripheral edge 29 of barrier panel 6 and peripheral edge 30 of bottom panel 8, so as to complete the formation of lower plenum 60.

At least one inlet/outlet opening 65 is formed in bottom perimeter band 16 that sealingly accepts an air supply hose 34. Inlet opening 65 is sized and shaped so that air supply hose 34 may be inserted, with the inlet being thereafter snapped shut or otherwise closed to hold air supply hose 34 in place while lower plenum 60 is charged with pressurized air. Inlet opening 65 may also include a valve (not shown) that is biased to be normally closed to prevent air from exiting through the inlet, and opened when air supply hose 34 is inserted into inlet opening 65. Other arrangements known to those skilled in the art may be used to inflate lower plenum 60. Top perimeter band 14 includes at least two and often three inlet/outlet openings 70*a*, 70*b*, 70*c*, that also sealingly accept air supply hose 34. Inlet/outlet opening 70*a* is arranged in flow communication with first plenum 46, inlet/outlet opening 70*b* is arranged in flow communication with central plenum 48, and inlet/outlet opening 70*c* is arranged in flow communication with second plenum 50. Of course, as a result of conduit 51 being arranged in flow communication with each of through-holes 42 so that first plenum 46 and second plenum 50 are in airflow communication with one another, and in airflow isolation from central plenum 50, only one of 70*a*, 70*c* need be provided in order to initiate inflation or deflation of first plenum 46 and second plenum 50.

It should be understood that some or all of top panel 4, barrier panel 6, bottom panel 8, longitudinal baffle-panels 10, transverse baffle-panels 12, top perimeter band 14, and bottom perimeter band 16, are most often, but not always formed from a sheet of fabric, e.g., nylon scrim or the like, and may be coated on at least their outer surfaces with a water proof coating. The water proof coating may be any of the well known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a durable water repellant (patient side). A practical benefit associated with the use of the foregoing materials is that partially deflatable, multichambered transfer mattress 2 retains a better appearance for longer periods of time during use.

Alternatively, in those instances where a single use, single patient mattress is provided, i.e., where patient use lasting less than twenty four hours is desired, some or all of top panel 4, barrier panel 6, bottom panel 8, longitudinal baffle-panels 10, transverse baffle-panels 12, top perimeter band 14, and bottom perimeter band 16 may be made of materials, such as, acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool, and including blends and partially blends of these materials together or with other compatible materials. A common characteristic of the foregoing and like materials is their propensity to stain or discolor as a result of contact with blood, urine, feces, hospital strength disinfecting compounds, alcohol, or the like. Additionally, a variety of films may be used to form a single patient, single use partially deflatable, multichambered transfer mattress 2, for example, copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, polyvinylidene chloride and including blends and partially blends of these materials together or with other compatible materials. A practical benefit associated with the use of the foregoing preferred materials is that partially deflatable, multichambered transfer mattress 2 retains a stained and discolored appearance for longer periods of time after use thereby alerting hospital staff or other care givers that a particular partially deflatable, multichambered transfer mattress 2 has completed its useful life, and must be discarded.

In one embodiment, some or all of top panel 4, barrier panel 6, bottom panel 8, longitudinal baffle-panels 10, transverse baffle-panels 12, top perimeter band 14, and bottom perimeter band 16 may comprise a cold water soluble partially hydrolyzed polyvinyl alcohol, cold water insoluble hot water disintegrable aliphatic polyester, and minor proportions of processing and performance aids. The aliphatic polyester has a melt temperature above the normal body temperature of a human (37 degrees C.; 98.6 degrees F.) and is present in the resin blend at a concentration sufficient to constitute the continuous phase of the blend, with the polyvinyl alcohol constituting a discontinuous phase of the blend. The aliphatic polyester renders the resin blend, and the partially hydrolyzed polyvinyl alcohol in the blend is, cold water insoluble and determines the temperature at which articles formed from the blend will be subject to dissolution in an aqueous bath and subsequent disposal. A practical benefit associated with the use of the foregoing material is that partially deflatable, multichambered transfer mattress 2 not only retains a stained and discolored appearance for longer periods of time after use, thereby alerting hospital staff or other care givers that a particular partially deflatable, multichambered transfer mattress 2 has completed its useful life, and must be discarded, but also if an attempt is made to launder the mattress after a single use it disintegrates during the washing process.

A partially deflatable, multichambered transfer mattress 2 is assembled according to the present invention in the following manner. Bottom panel 8 is laid out on a suitable support surface so that baffle-panels 12 may be transversely arranged in the center section of the inner surface of bottom panel 8. Once in this position, bottom edge 56 of each transverse baffle-panel 12 is fixedly fastened, e.g., via heat sealing, ultrasonic welding, or adhesive, to the inner surface of bottom panel 8. In this way, a re-solidified interface structure is formed so as to improve the bond and its resistance to rupture under normal loading. Once transverse baffle-panels 12 are fastened to the inner surface of bottom panel 8, barrier panel 6 is arranged in overlying confronting relation with bottom panel 8 so that each top edge 54 of each transverse baffle-panel 12 may be fixedly fastened to bottom inner surface 26 of barrier panel 6, e.g., via heat sealing, ultrasonic welding, or adhesive.

At this stage of the construction, longitudinal baffle-panels 10 may be arranged in spaced-apart, substantially parallel relation to one another on top inner surface 24 of barrier panel 6. Once in this position, bottom edge 40 of each longitudinal baffle-panel 10 is fixedly fastened to top inner surface 24 of barrier panel 6. Longitudinal baffle-panels 10 are heat sealed along the interface between bottom edge 40 and top inner surface 24 of barrier panel 6. This heat sealing may be done with the application of heat or ultra sonic energy at the edge interface. In this way, a re-solidified interface structure is formed so as to improve the bond and its resistance to rupture under normal loading. Also, conduit 51 may be arranged in flow communication with each of through-holes 42 and similarly fastened to each of longitudinal baffle-panels 10.

Once each longitudinal baffle-panel 10 is fastened to top inner surface 24 of barrier panel 6, top panel 4 is arranged in overlying confronting relation with barrier panel 6. In this position, each top edge 38 of each longitudinal baffle-panel 10 is fixedly fastened to the inner surface of top panel 4. The edges of top perimeter band 14 are then sealingly fastened to peripheral edge 22 of top panel 4 and peripheral edge 29 of barrier panel 6, respectively, and the edges of bottom perimeter band 16 are then sealingly fastened to peripheral edge 29 of barrier panel 6 and peripheral edge 30 of bottom panel 8 so as to complete assembly of partially deflatable, multichambered transfer mattress 2.

Figure 5:
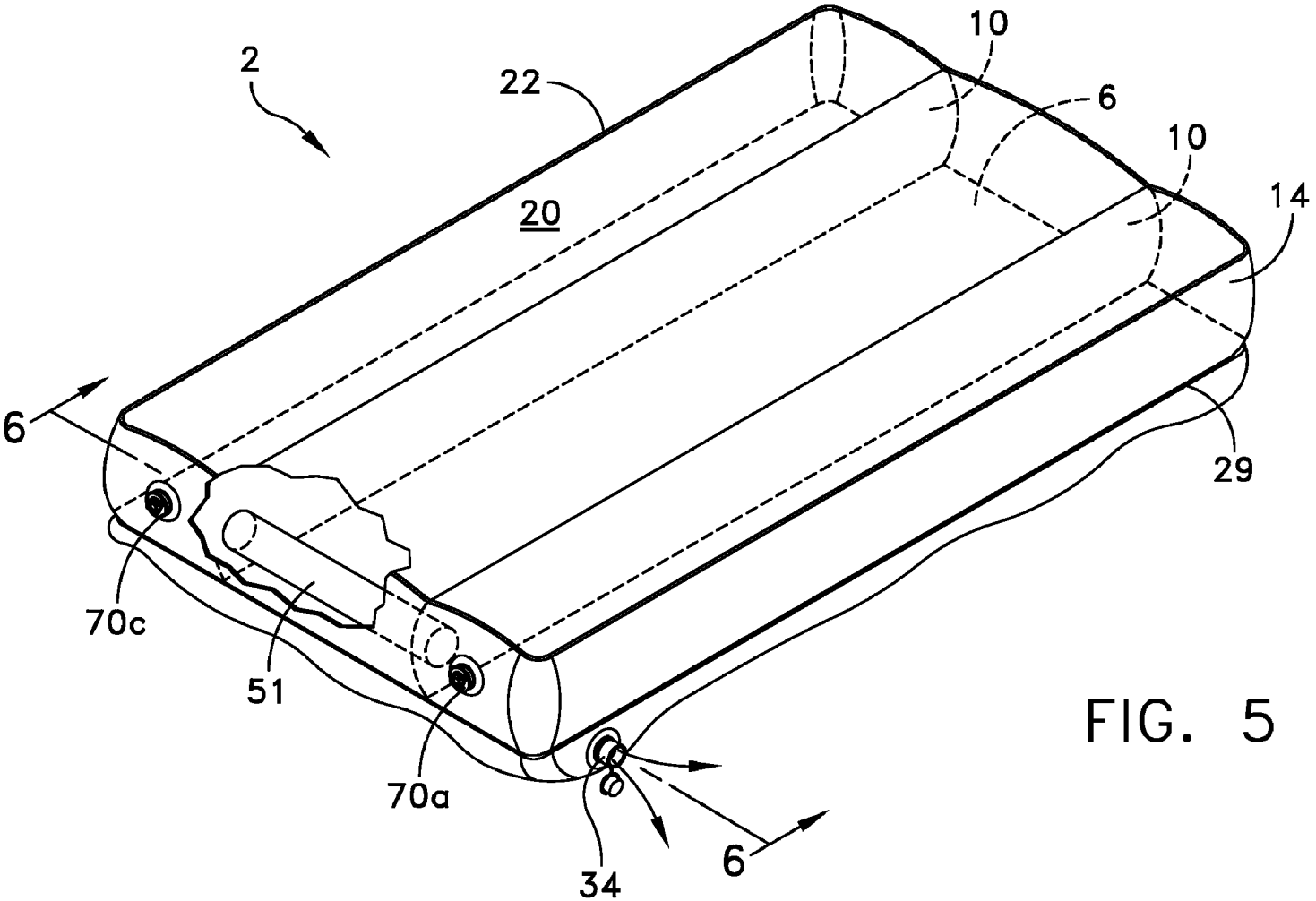
FIG. 5 is a perspective view of the multichambered transfer mattress shown in FIGS. 1 and 2, with a bottom plenum deflated.
Figure 6:
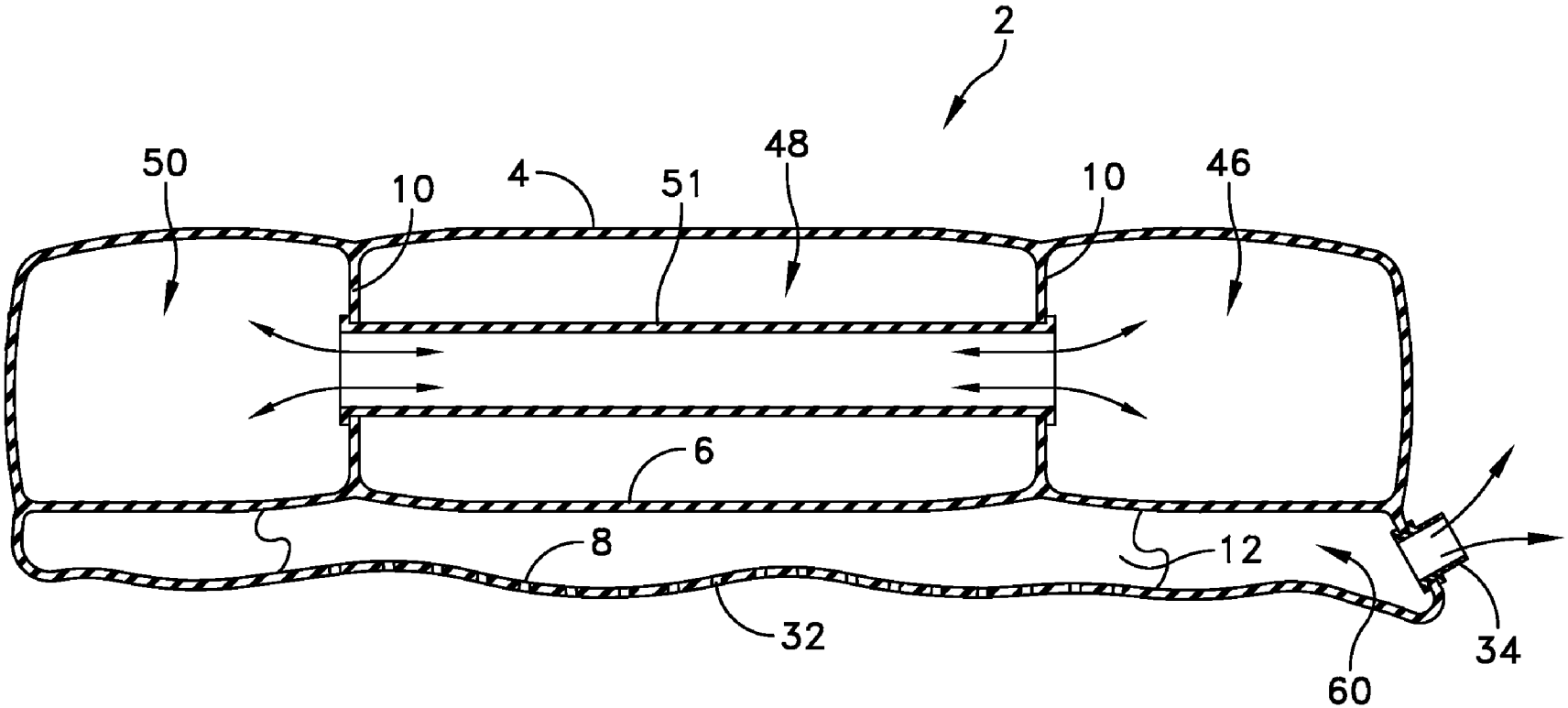
FIG. 6 is a cross-sectional view of the multichambered transfer mattress shown in FIG. 5, as taken along lines 6-6.
Figure 7:
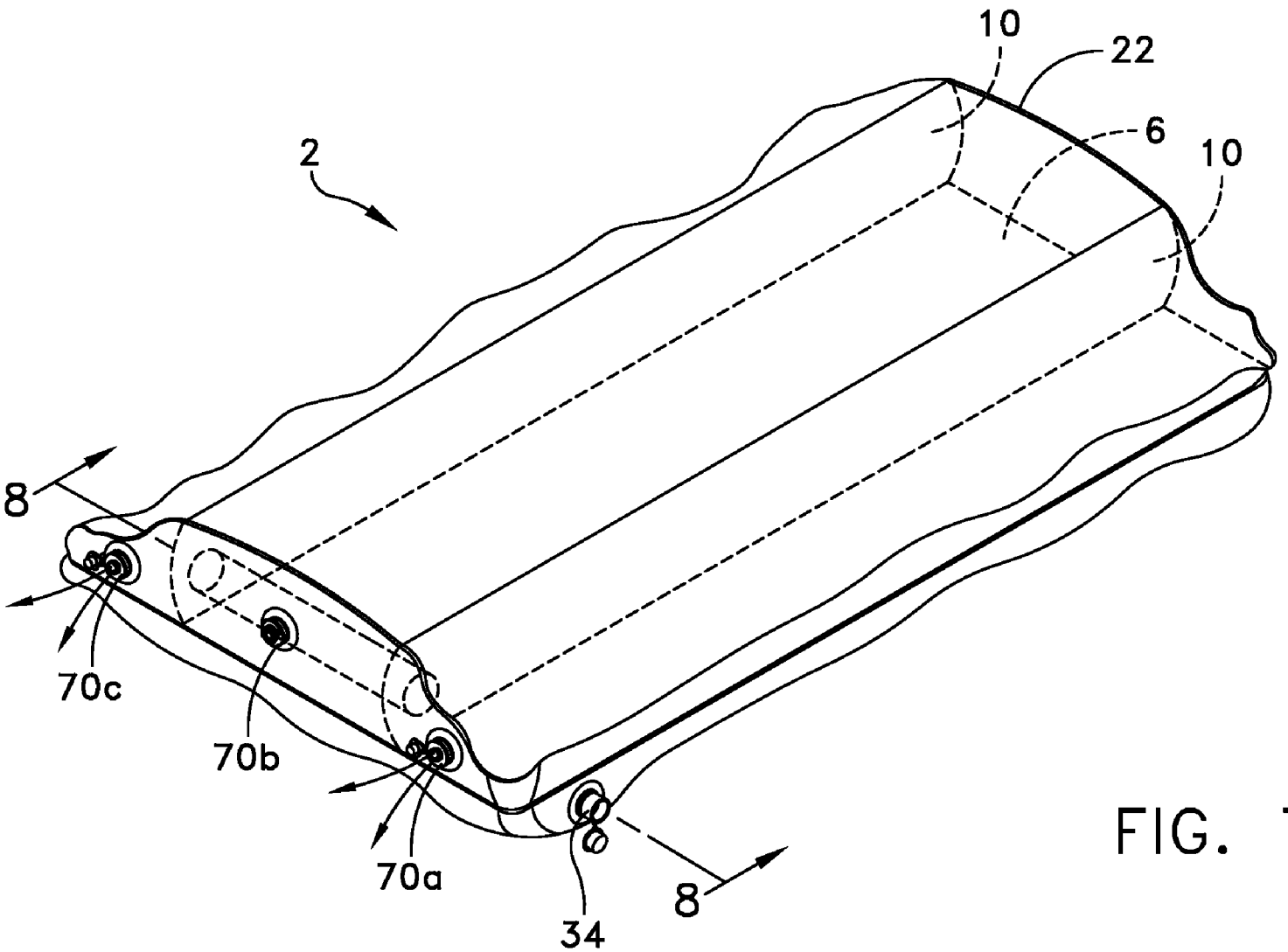
FIG. 7 is a perspective view of the multichambered transfer mattress shown in FIGS. 1 and 2, with a bottom plenum and side plenums deflated.
Figure 8:
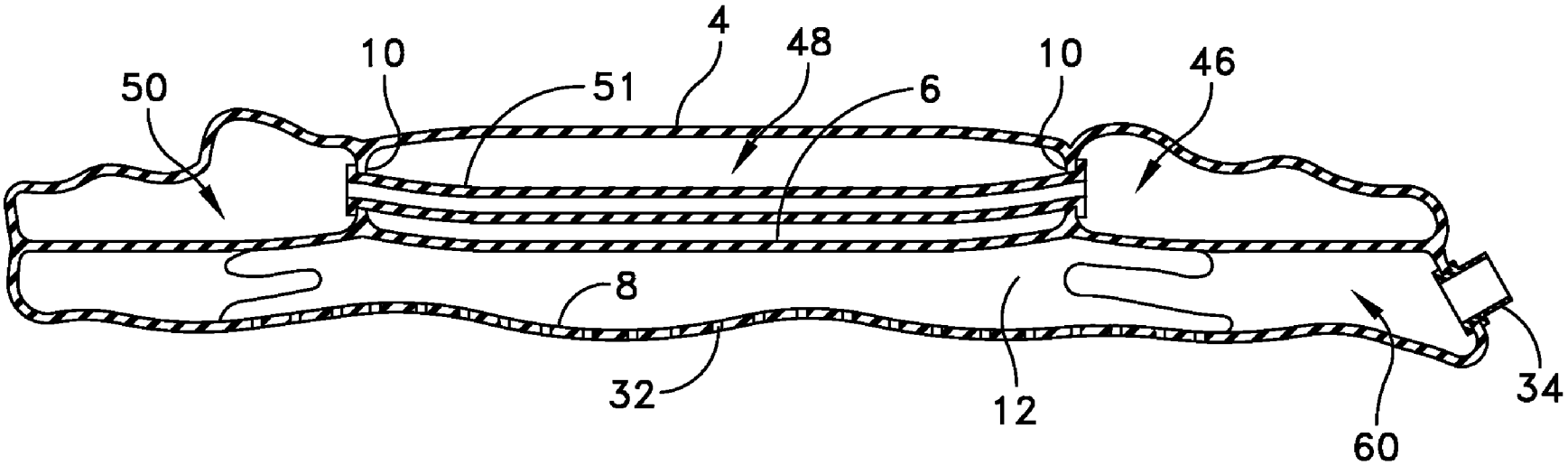
FIG. 8 is a cross-sectional view of the multichambered transfer mattress shown in FIG. 7, as taken along lines 8-8.
Figure 9:
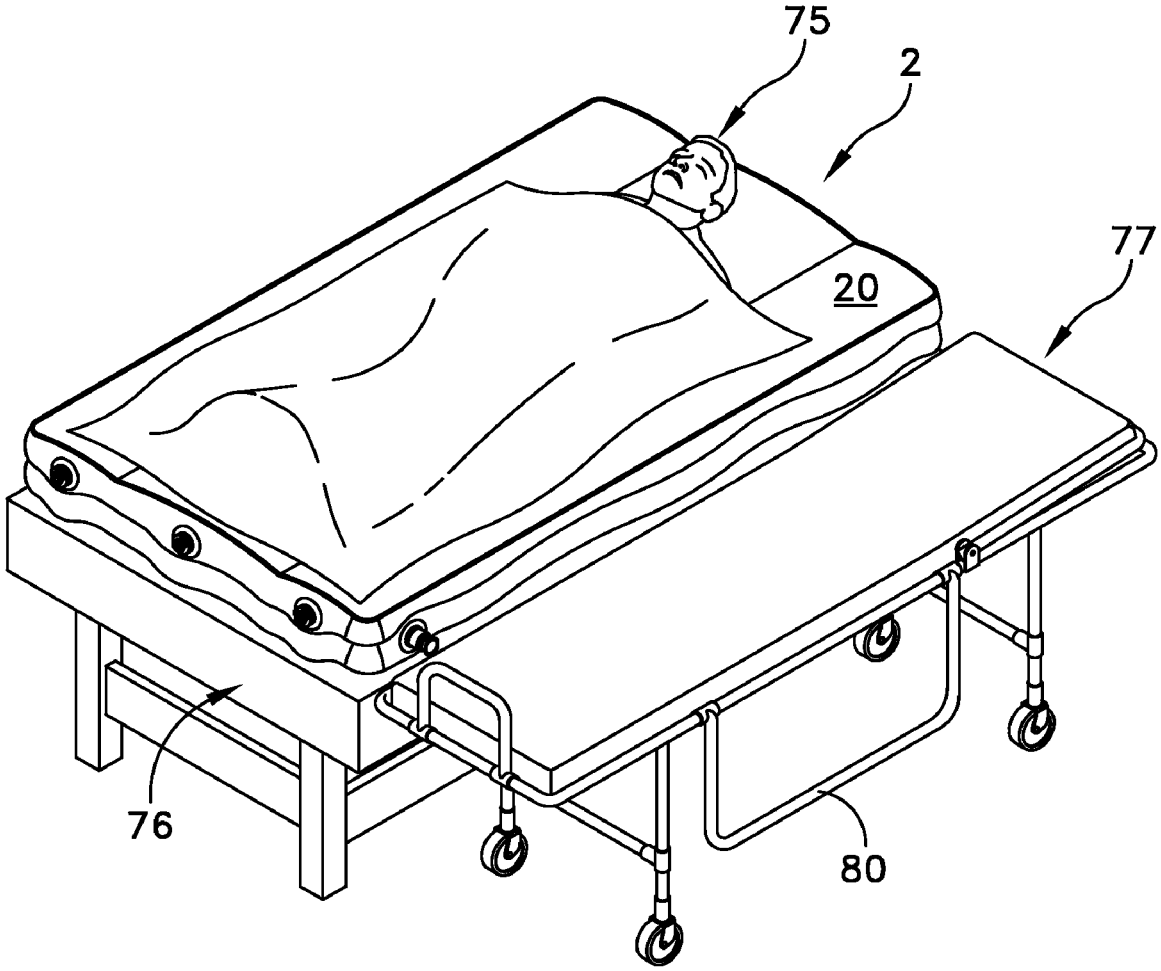
FIG. 9 is a perspective view of the multichambered transfer mattress shown in FIGS. 1-2, positioned atop a support surface, with its lower plenum deflated, and prior to transfer to a mobile transport device.
Figure 10:
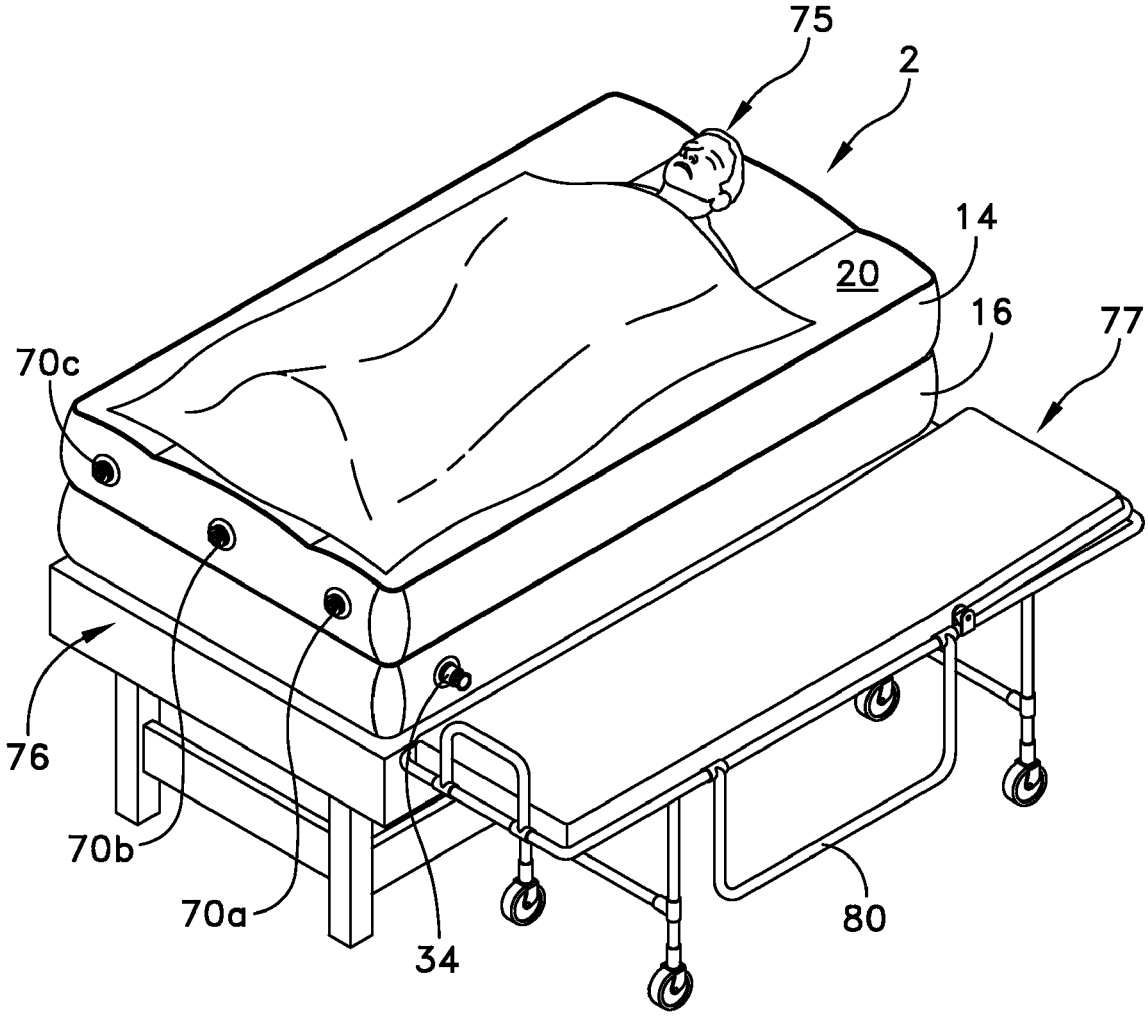
FIG. 10 is a perspective view of the multichambered transfer mattress shown in FIG. 9, positioned atop a support surface, with its lower plenum inflated, and ready to transfer to a mobile transport device.
Figure 13:
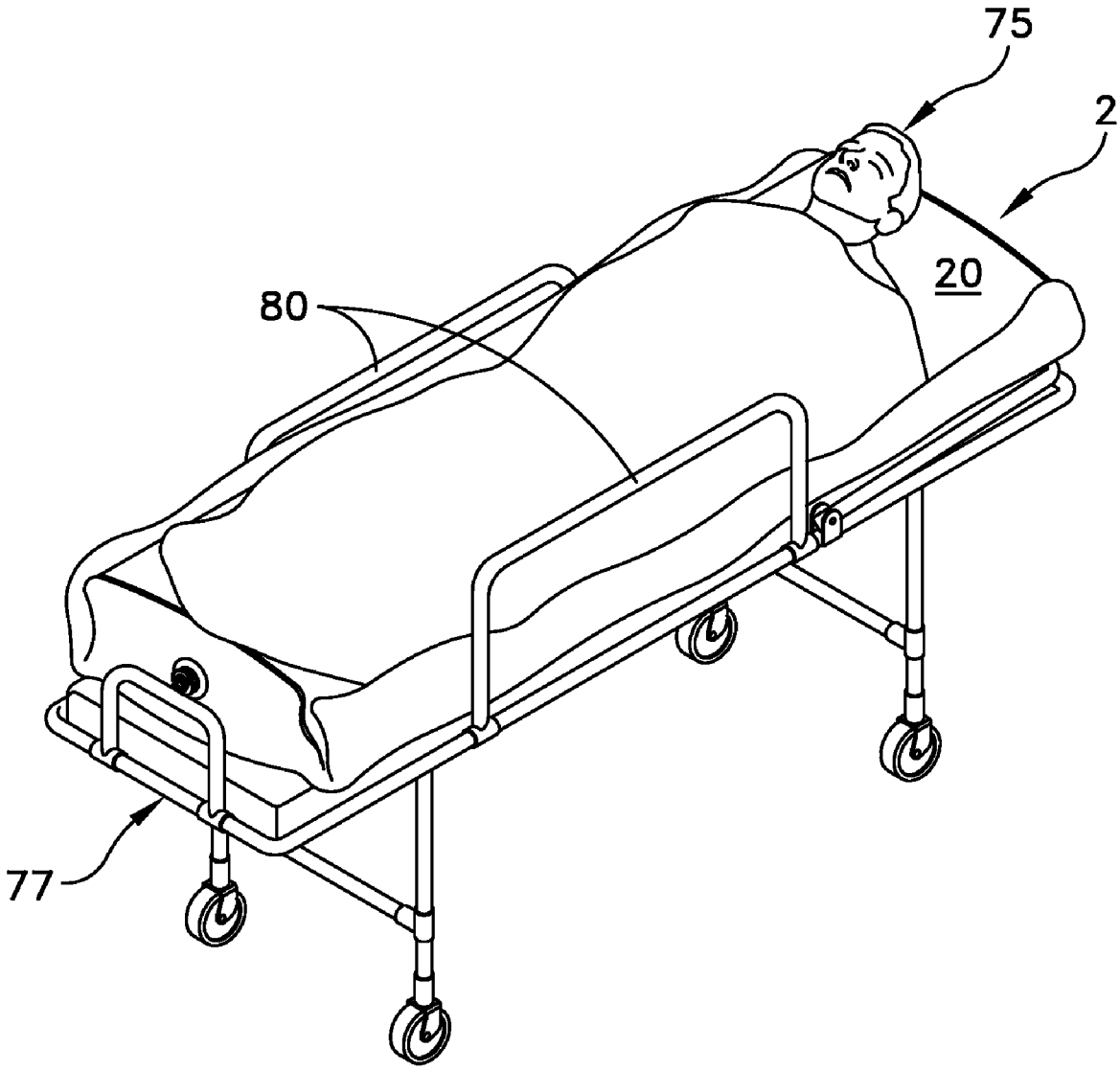
FIG. 13 is a perspective view of the multichambered transfer mattress shown in FIG. 12, positioned atop a mobile transport device with its lower plenum and side communicating plenums deflated and with the side rails of the mobile transport device fully extended.
Figure 14:
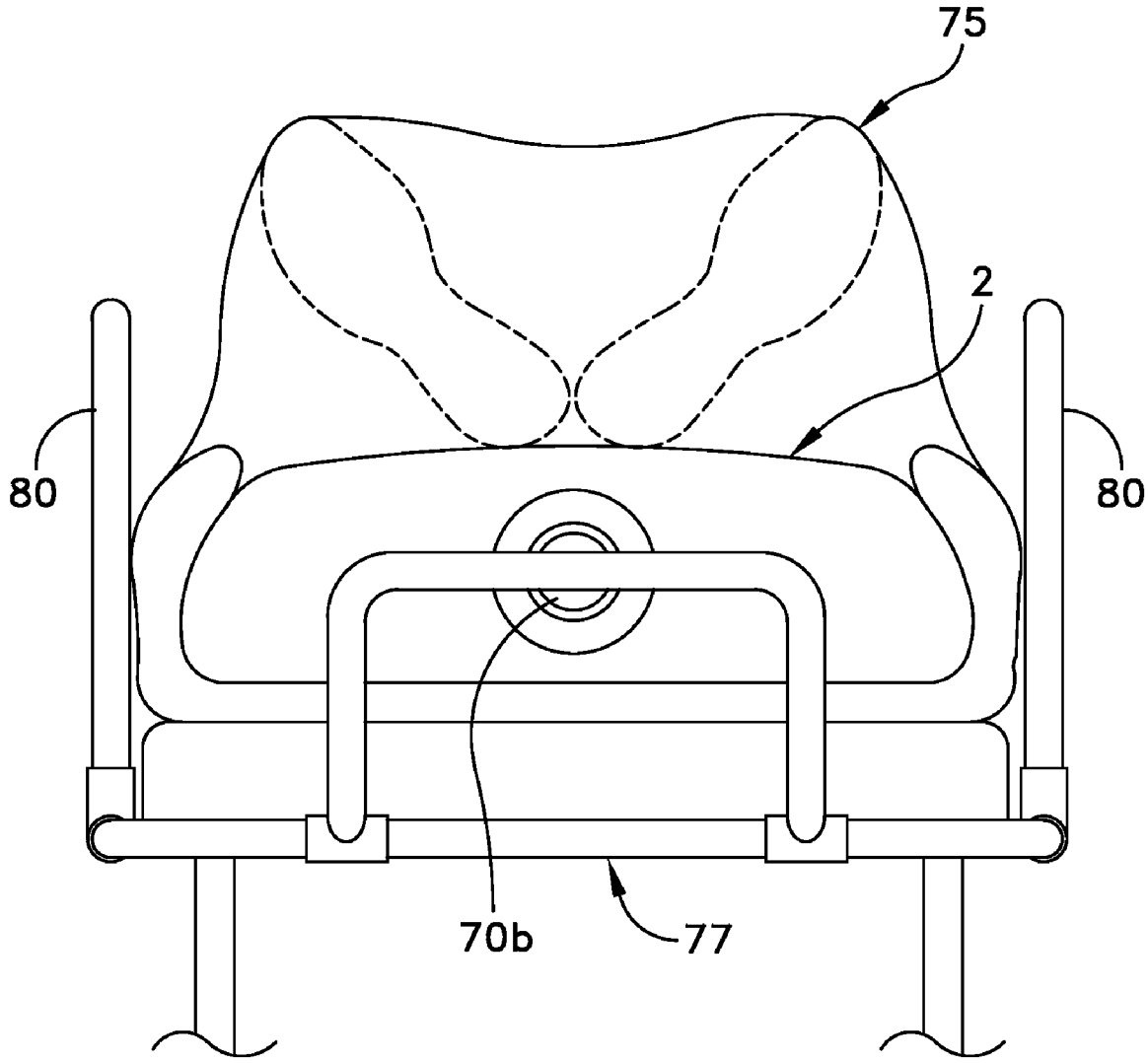
FIG. 14 is an end view of the multichambered transfer mattress shown in FIG. 13, positioned atop a mobile transport device with its lower plenum and side communicating plenums deflated and with the side rails of the mobile transport device fully extended.

Advantageously, first plenum 46 and second plenum 50 are in air flow communication with one another via conduit 51, isolated from central plenum 48, and each of first plenum 46, central plenum 48, and second plenum 50 are isolated from lower plenum 60. In this way, first plenum 46, central plenum 48, and second plenum 50 may be fully inflated, i.e., pressurized above ambient pressure, while lower plenum 60 is deflated, i.e., at or below ambient pressure (FIGS. 5 and 6). This configuration being suitable for a patient 75 to lie upon while at a stationary location, i.e., a hospital bed, operating table, or support platform of a diagnostic instrument 76 (FIGS. 9 and 10). Advantageously, first plenum 46 and second plenum 50 may be deflated along with lower plenum 60, while central plenum 48 remains inflated and capable of comfortably supporting a patient upon a mobile transport 77 of the type that include side rails 80 (FIGS. 7-8 and 11-14). Side rails 80 on conventional mobile transports 77 are located on each longitudinal side of mobile transport 77 in spaced apart relation to one another, and constructed so as to be movable from between a first fully retracted position (FIGS. 9-12) and a second fully extended position (FIGS. 13-14).

Figure 11:
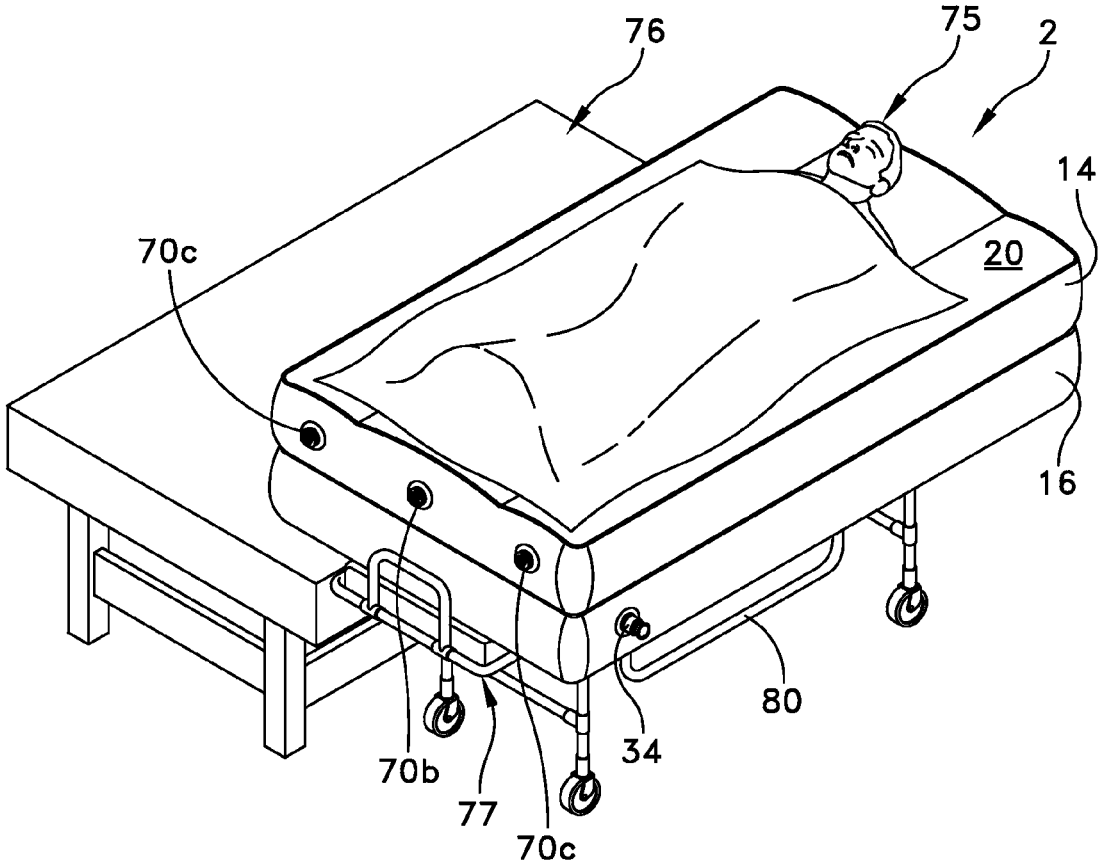
FIG. 11 is a perspective view of the multichambered transfer mattress shown in FIG. 10, positioned atop a mobile transport device with its lower plenum inflated, but with the side rails of the mobile transport device fully retracted.
Figure 12:
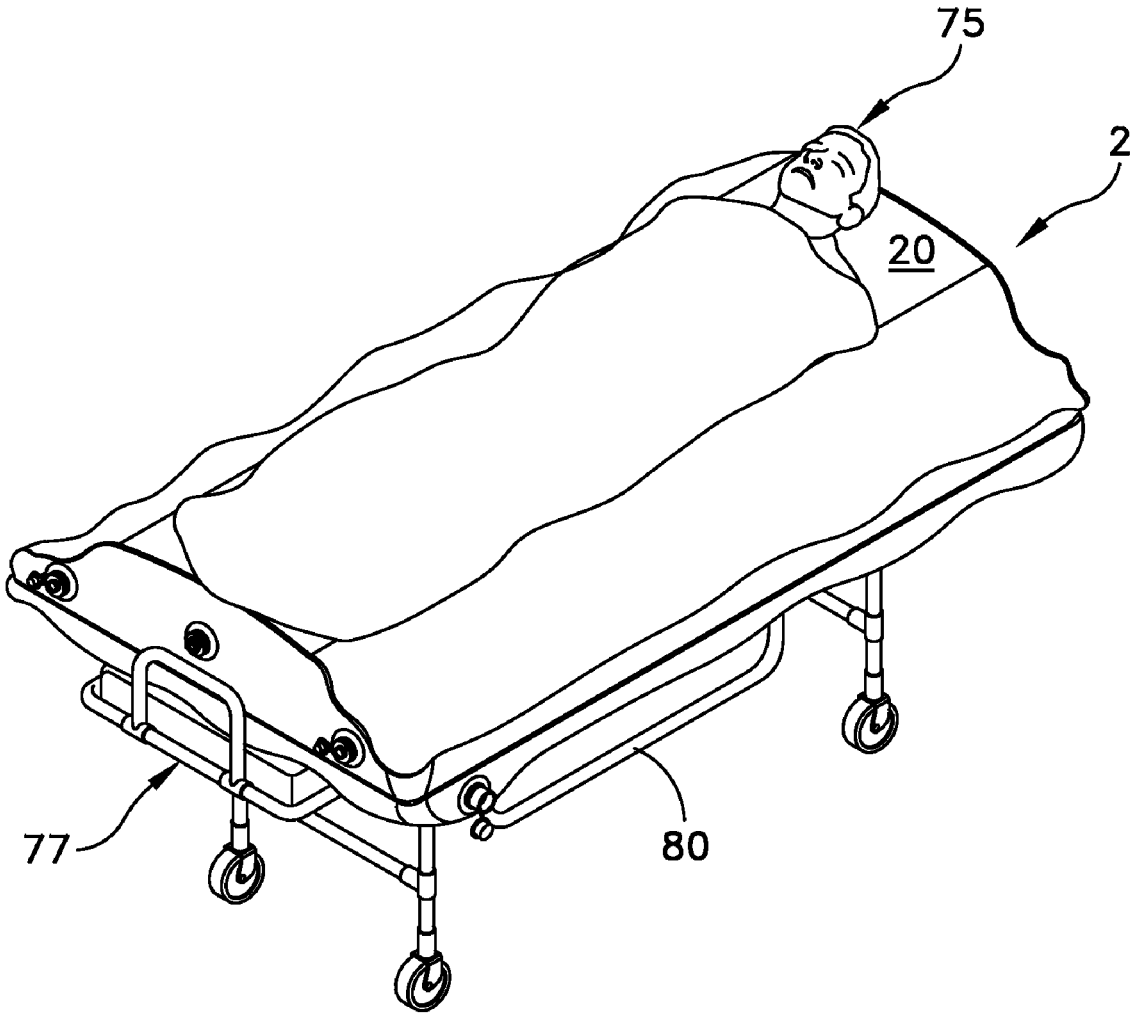
FIG. 12 is a perspective view of the multichambered transfer mattress shown in FIG. 11, positioned atop a mobile transport device with its lower plenum and side communicating plenums deflated, and ready for the side rails of the mobile transport device to be fully extended.

Patient 75 may be moved from a bed 76 or the like by first being positioned upon top surface 20 of multichambered transfer mattress 2. Pressurized air is then pumped into first plenum 46, central plenum 48, second plenum 50, via inlet/outlet openings 70*a*, 70*b*, 70*c* using air supply hose 34. It will be understood that inlet/outlet openings 70*a*, 70*b*, 70*c* are closable so as to prevent deflation to occur unintentionally. Also, the sequence of inflation or deflation may be altered as needed or desired by the user. Once in this position, pressurized air is then pumped into lower plenum 60, via inlet opening 65 using air supply hose 34, so as to pressurize lower plenum 60 with pressurized air. When the pressurized air escapes through perforations 32 it creates an air bearing under multichambered transfer mattress 2 (FIG. 10). Multichambered transfer mattress 2 may then be slid from its position on bed 76 to the top surface of mobile transport 77 (FIG. 11). In order to allow for this transfer, side rails 80 must be lowered to their first fully retracted position. However, when multichambered transfer mattress 2 is located on top of mobile transport 77, its overall width is generally greater than the overall width of the mobile transport so that side rails 80 may not be moved back to their second fully extended position. In order to facilitate the movement of side rails 80 into proper position on either side of patient 75, first plenum 46 and second plenum 50 may be deflated by releasing either of inlet/outlet openings 70*a*, 70*c*. In this way, air escapes from first plenum 46 and second plenum 50, while pressurized air remains in central plenum 48 due to its isolated configuration. Once first plenum 46 and second plenum 50 are deflated each of side rails 80 may be moved from its first fully retracted position to its second fully extended position, so that the patient may be transported safely upon the mobile transport. To remove multichambered transfer mattress 2 from mobile transport 77, the foregoing process is simply reversed.

It is to be understood that the present invention is by no means limited only to the particular constructions herein disclosed and shown in the drawings, but also comprises any modifications or equivalents within the scope of the claims.

What is claimed is:

1. A mattress comprising spaced apart top and bottom panels that are separated by a pair of spaced apart, longitudinally extending baffle-panels and a circumferentially located perimeter band and three adjacent longitudinally oriented plenums and at least two separate inlet/outlet valves that are each arranged in airflow communication with a respective one of said three adjacent plenums wherein two of said plenums are spaced apart from one another and arranged so as to communicate with one another, and a third of said plenums is located between said spaced apart plenums and arranged in airflow isolation from said communicating plenums so that said communicating plenums are at least one of inflatable and deflatable independently of said third plenum through a conduit that extends between said longitudinally extending baffle-panels and through said isolated plenum.

2. A mattress according to claim 1 wherein said third plenum is inflated so as to support a load and said spaced apart plenums are deflated.

3. A transfer mattress comprising:

an upper mattress having a top panel, a pair of spaced apart, longitudinally extending baffle-panels and a circumferentially located perimeter band, and three longitudinally oriented plenums and at least two separate inlet/outlet valves that are each arranged in airflow communication with a respective one of said three plenums wherein two of said plenums are arranged so as to communicate with one another while a third of said plenums is arranged in airflow isolation from said communicating plenums that are thereby inflatable and deflatable independently of said third plenum through a conduit that extends between said longitudinally extending baffle-panels and through said isolated plenum; and a lower inflatable mattress that is isolated by a common wall from said upper mattress having a lower inlet/outlet valve arranged in airflow communication with a lower plenum and a bottom wall comprising a plurality of perforations so that when said lower plenum is charged with pressurized air, said air escapes under pressure through said perforations to create an air bearing under said transfer mattress.

4. A transfer mattress according to claim 3 wherein said isolated plenum is pressurized above ambient pressure so as to support a load while said communicating plenums and said lower inflatable mattress are at ambient pressure.

5. A transfer mattress comprising:

an upper mattress including a top panel, a pair of spaced apart, longitudinally extending baffle-panels and a circumferentially located perimeter band defining a first longitudinally oriented plenum having a first inlet/outlet valve arranged in airflow communication with said first plenum, a central longitudinally oriented plenum having a central inlet/outlet valve arranged in airflow communication with said central plenum, and a second longitudinally oriented plenum, wherein said first and second plenums are arranged so as to communicate with one another through a conduit that extends between said longitudinally extending baffle-panels and through said central plenum, and said central plenum is arranged in airflow isolation from said first plenum and said second plenum; and a lower inflatable mattress separated by a common wall from said upper mattress, a lower inlet/outlet valve arranged in airflow communication with a lower plenum defined by said lower inflatable mattress, and a bottom wall comprising a plurality of perforations so that when said lower plenum is charged with pressurized air through said lower inlet/outlet valve, the escape of said air under pressure through said perforations creates an air bearing.

6. A transfer mattress according to claim 5 wherein said central plenum is pressurized above ambient pressure so as to support a load while said communicating plenums and said lower inflatable mattress are at ambient pressure.

* * * * *